United States Patent [19]

Chateau

[11] Patent Number: 4,689,942

[45] Date of Patent: Sep. 1, 1987

[54] DEVICE AND METHOD FOR ASSEMBLING THREADS

[75] Inventor: Fernand Chateau, Pont-du-Chateau, France

[73] Assignee: Compagnie Generale des Establissements Michelin, Clermont-Ferrand, France

[21] Appl. No.: 892,694

[22] Filed: Aug. 1, 1986

[30] Foreign Application Priority Data

Aug. 7, 1985 [FR] France ..... 85 12192

[51] Int. Cl.[4] ..... D01H 7/88; D01H 7/90; D02G 3/28

[52] U.S. Cl. ..... 57/58.36; 57/58.52

[58] Field of Search ..... 57/58.3–58.38, 57/58.52–58.57

[56] References Cited

U.S. PATENT DOCUMENTS

| | | | |
|---|---|---|---|
| 2,731,785 | 1/1956 | Vibber | 57/58.36 |
| 2,752,749 | 7/1956 | Halleux | 57/58.36 X |
| 2,811,012 | 10/1957 | Klein | 57/58.3 |
| 2,871,648 | 2/1959 | Vibber | 57/58.36 |
| 4,592,195 | 6/1986 | Charbonnier | 57/58.52 X |

FOREIGN PATENT DOCUMENTS

| | | |
|---|---|---|
| 500924 | 2/1951 | Belgium . |
| 2263315 | 10/1975 | France . |
| 992909 | 5/1965 | United Kingdom . |

*Primary Examiner*—John Petrakes

*Attorney, Agent, or Firm*—Brumbaugh, Graves, Donohue & Raymond

[57] ABSTRACT

A device for assembling at least two threads comprises two groups of bobbins; a wall and means for driving the wall in rotation around an axis; and means for twisting a first thread in the direction of rotation of the wall, the twisting means permitting the first thread to come into contact with the inner face of the wall and to turn around the axis while turning around the second bobbin.

14 Claims, 2 Drawing Figures

DEVICE AND METHOD FOR ASSEMBLING THREADS

The present invention concerns devices for assembling threads, particularly textile threads.

The expression "thread" is to be understood in a very broad sense. A thread may be a "single thread" formed, for instance, of one or more filaments. When the single thread is formed of a single filament, it is called a "monofilament", and when the single thread is formed of several filaments, it is called a "multifilament."

A thread may furthermore itself be formed of an assembly of single threads. Such an assembly is called a "ply" when it is formed of several single threads combined by a single twisting operation and such an assembly is called a "cable" when it is formed of several threads at least one of which is a ply thread which are combined by one or more twisting operations.

The invention concerns, in particular, the devices for assembling at least two threads by first of all imparting a twist to each of the threads separately in the same direction and then twisting these threads together in the opposite direction in order to obtain an assembly.

The known devices of this type generally employ rotating disks and lead to the following drawbacks:

high tension of the threads;

high inertia of the devices.

These drawbacks lead to assemblies which have mechanical properties which are poorer than those which can be expected.

The object of the invention is to remedy these drawbacks.

Accordingly, the invention concerns a device for assembling at least two threads which comprises:

(a) a first group and a second group of bobbins, the first group being formed by at least one first bobbin on each of which is wound at least one first thread and the second group being formed by at least one second bobbin on each of which is wound at least one second thread;

(b) a wall and means for driving the wall in rotation around an axis;

(c) means either for immobilizing the second bobbin during the rotation of the wall or for imparting to the second bobbin a rotation independent of the rotation of the wall;

(d) first twisting means for twisting the first thread in the direction of rotation of the wall, the first twisting means being formed, at least in part, by a first upstream guide, a first downstream guide and the wall; the first twisting means permitting the first thread to come into contact with the inner face of the wall between said first guides and to turn jointly with the wall around the axis, turning around the second bobbin without making contact with the second bobbin;

(e) second twisting means for twisting the second thread in the direction of rotation of the wall, the second twisting means being formed, at least in part, by a second upstream guide and a second downstream guide; the direction of displacement along the axis of rotation in order to pass from the second upstream guide to the second downstream guide being the same as the direction of displacement along the axis of rotation in order to pass from the first upstream guide to the first downstream guide;

(f) means for driving the downstream guides in rotation around the axis of rotation of the wall in the same direction and at the same angular speed as the wall; and (g) means for assembling the first thread with the second thread after the passage of these threads over the downstream guides by twisting these threads together in a direction opposite the direction of rotation of the wall.

The invention also concerns a method for assembling at least two threads which comprises:

(a) using a first group and a second group of bobbins, the first group being formed by at least one first bobbin on each of which is wound at least one first thread and the second group being formed by at least one second bobbin on each of which is wound at least one second thread;

(b) using a wall which is driven in rotation around an axis;

(c) either immobilizing the second bobbin during the rotation of the wall or imparting to the second bobbin a rotation independent of the rotation of the wall;

(d) twisting the first thread in the direction of rotation of the wall in such a manner that the first thread comes into contact with the inner face of the wall and turns jointly with the wall around the axis, turning around the second bobbin without making contact with the second bobbin;

(e) twisting the second thread in the direction of rotation of the wall; the direction of displacement along the axis of rotation upon these twistings being the same for the first thread as for the second thread; and (f) assembling the first thread with the second thread by twisting these threads together in the direction opposite the direction of rotation of the wall.

The invention also concerns the assemblies of threads obtained with this device and method.

The embodiments which are described below, as well as the entirely schematic figures of the drawing corresponding to these embodiments, are intended to illustrate the invention and facilitate an understanding of it without, however, limiting its scope.

Figure 1:
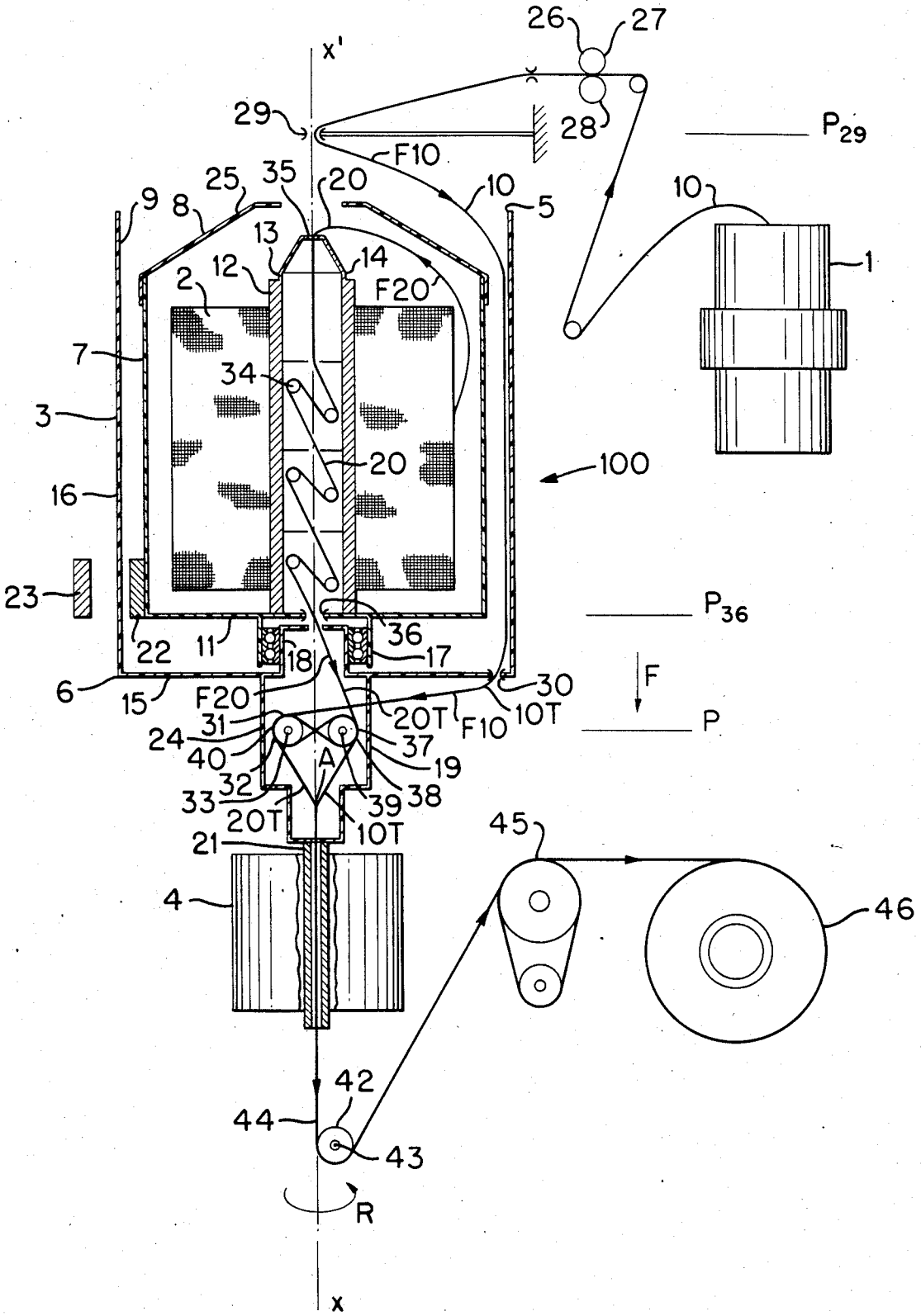
FIG. 1 shows in cross-sectional view a device in accordance with the invention.

FIG. 1 shows a device 100 in accordance with the invention. This device 100 has a first bobbin 1 and a second bobbin 2. A first thread 10 is wound on the bobbin 1 and a second thread 20 is wound on the bobbin 2. Each of these threads 10, 20 is formed, for instance, of an untwisted multifilament. The device 100 comprises a wall formed of a drum 3 and a motor 4 for driving the drum 3 in rotation around the axis xx' which is, for instance, vertical, FIG. 1 being a section taken along this axis. The drum 3 has two ends: the upper end 5 and the lower end 6.

The bobbin 1 is arranged outside the drum 3 and the bobbin 2 is arranged inside the drum 3.

The bobbin 2 is arranged within a pot 7 which is provided with a cover 8, the pot 7 being itself arranged within the drum 3 while being without contact with the inner face 9 of the drum 3, that is to say the bobbin 2 has no contact with the inner face 9. The bobbin 2 is arranged on the bottom 11 of the pot 7. The bobbin 2 has a mandrel 12 around which the thread 20 is wound, and within the mandrel 12 there is a hollow cylinder 13 which is part of a regulator system 14 for the thread 20, this regulator system 14 being described in greater detail further below.

The drum 3 is connected at its lower end 6 to a plate 15, the assembly consisting of the drum 3 and the plate 15 forming a bell-shaped enclosure 16 of which the plate 15 constitutes the bottom, the pot 7, with the bobbin 2 and the regulator system 14, being located within the bell 16. The bell 16 turns around the axis xx'. The device 100 comprises means either for immobilizing the bobbin 2 during the rotation of the drum 3 or for imparting to the bobbin 2 a rotation independent of the rotation of the drum 3. These means are as follows. The bottom 11 of the pot 7 is firmly attached to a cylindrical bearing 17 of axis xx', this bearing 17 being of the ball bearing type. This bearing 17 can turn around a cylindrical part 18 which is firmly attached to the plate 15. This cylindrical part 18 is also firmly attached to a hollow spindle 19 which, in its turn, is firmly attached to a drive cylinder 21 of the motor 4. A magnet 22 if fastened on the pot 7. Facing this magnet 22 there is another magnet 23, the drum 3 being arranged between these two magnets 22, 23 which are without contact with the drum 3. The assembly 24 comprising the bell 16, the cylindrical part 18, the spindle 19 and the drive cylinder 21, is driven by the motor 4 as one piece in rotation around the axis xx', and therefore constitutes a rotating assembly. The assembly 25, comprising the pot 7 with its cover 8, the bearing 17, the bobbin 2, the mandrel 12, the regulator system 14 and the magnet 22, is immovable with respect to the axis xx' during the rotation of the rotating assembly 24 if the outer magnet 23 is stationary, or it turns around the axis xx', independently of the rotation of the rotating assembly 24, if the outer magnet 23 is caused to turn around the axis xx', this due to the presence of the bearing 17. The drum 3 and the pot 7 are formed of materials which are permeable to the magnetic field so as to permit attraction between the magnets 22, 23, these materials being, for instance, plastics.

The device 100 operates as follows:

The thread 10 coming from the bobbin 1 is braked by a regulator system 26 which permits adjustment of the tension of the thread 10, this system being formed, for instance, by two rollers 27, 28. The thread 10 then passes into a first stationary upstream guide 29 arranged above the drum 3, this guide 29 being a circular eye with axis xx'. This guide 29 permits the thread 10 to penetrate into the drum 3 through the upper end 5 of the drum 3. The thread 10 passes through the drum 3 on the outside of the pot 7 and emerges again through the guide 30 rigidly fastened to the bell 16, this guide 30 being, for instance, an eye provided in the plate 15. The eye 30 is arranged in the vicinity of the lower end 6 of the drum 3.

The thread 10 thus passes through the drum 3 from its upper end 5 towards its lower end 6 in the direction indicated by the arrow F10. The thread 10 then passes over a first movable downstream guide 31 arranged outside the bell 16 and below it in the vicinity of the axis xx', this downstream guide 31 turning in the same direction and at the same angular speed as the drum 3. This downstream guide 31 is formed by a roller 32 whose shaft 33 is rigidly connected to the hollow spindle 19 which supports the plate 15.

Upon the rotation of the rotating assembly 24, and therefore upon the rotation of the drum 3, this rotation being schematically indicated by the arrow R surrounding the axis xx', the thread 10, driven by the centrifugal force, applies itself against the inner face 9 of the drum 3, turning jointly with the drum 3 around the pot 7, and therefore the bobbin 2, without there being any contact between the thread 10, on the one hand, and the pot 7 and bobbin 2, on the other hand. The thread 10 is thus subjected to a twist in the same direction as the rotation of the drum 3 between the upstream guide 29 and the downstream guide 31, the thread 10 thus becoming the twisted multifilament 10T.

The thread 20 delivered by the bobbin 2 passes into the regulator system 14. This system 14 comprises the cylinder 13 within which cups 34 are arranged. The thread 20 penetrates into the cylinder 13 from the upper end 35 of the cylinder 13 and then passes, in succession, into the cups 34 whose shafts are firmly connected to the cylinder 13. Each of these cups 34 is formed, in known manner, of two disks with springs which apply the disks against the thread 20 located between them, so as to be able to apply an adjustable braking force to the thread 20 and thus to regulate the tension of the thread 20.

For purposes of simplification, the different parts of the cups 34 have not been shown in the drawing. The thread 20 then passes into the second upstream guide 36 formed by an eye arranged in the bottom 11 of the pot 7, the axis of this eye 36 being the axis xx'. The thread 20 then emerges from the drum 3 and passes over the second movable downstream guide 37 which is arranged outside the bell 16 and beneath it in the vicinity of the axis xx'. The advance of the thread 20 is indicated schematically by the arrow F20. This downstream guide 37 rotates in the same direction and at the same angular speed as the drum 3. Between the upstream guide 36 and the downstream guide 37, the thread 20 is twisted in the direction of rotation of the drum 3 in order to form the twisted multifilament 20T. In a manner similar to the downstream guide 31 of the thread 10, the downstream guide 37 of the thread 20 is formed by a roller 38 whose shaft 39 is integral with the hollow spindle 19. The shafts 33, 39 of the rollers 32, 38 are parallel to each other and located in the same horizontal plane P, on opposite sides of the axis xx', at the same distance from the axis xx'. These rollers 32, 38 are located on the inside of the spindle 19. When the assembly 25 is stationary, that is to say when the outer magnet 23 is stationary, the upstream guide 36 is stationary and the pitches of the twists imparted in the device 100 to the threads 10 and 20 are equal.

When the assembly 25 turns around the axis xx', independently of the assembly 24, due to the rotation of the outer magnet 23 around the axis xx', the upstream guide 36 turns around the axis xx' and the pitches of the twists imparted in the device 100 to the threads 10 and 20 are different, the twist imparted to the thread 20, between the upstream guide 36 and the downstream guide 37, increasing if the assembly 25 turns in the direction opposite the rotating assembly 24 or decreasing if the assembly 25 turns in the same direction as the rotating assembly 24 at an angular speed less than that of the rotating assembly 24.

The direction of displacement along the axis xx' of each thread 10, 20 in order to go from the upstream guide 29, 36 to the downstream guide 31, 37 corresponding to this thread is, by definition, the direction in which it is necessary to move along the axis xx' in order to pass from a plane passing through the upstream guide 29, 36 to a plane passing through the downstream guide 31, 37 corresponding to this thread, these planes being perpendicular to the axis xx'. The plane P29 is such a plane passing through the upstream guide 29 of the thread 10, the plane P36 is such a plane passing through the upstream guide 36 of the thread 20, and the plane P is such a plane passing through the downstream guides 31, 37, these planes P29, P36 and P being represented by straightline segments in FIG. 1. The planes P29, P36 are located above the plane P and therefore the direction of displacement along the axis xx' in order to pass from the upstream guide 29, 36 to the downstream guide 31, 37 is the same for the thread 10 as for the thread 20, since it is directed from top to bottom, in accordance with the arrow F.

Figure 2:
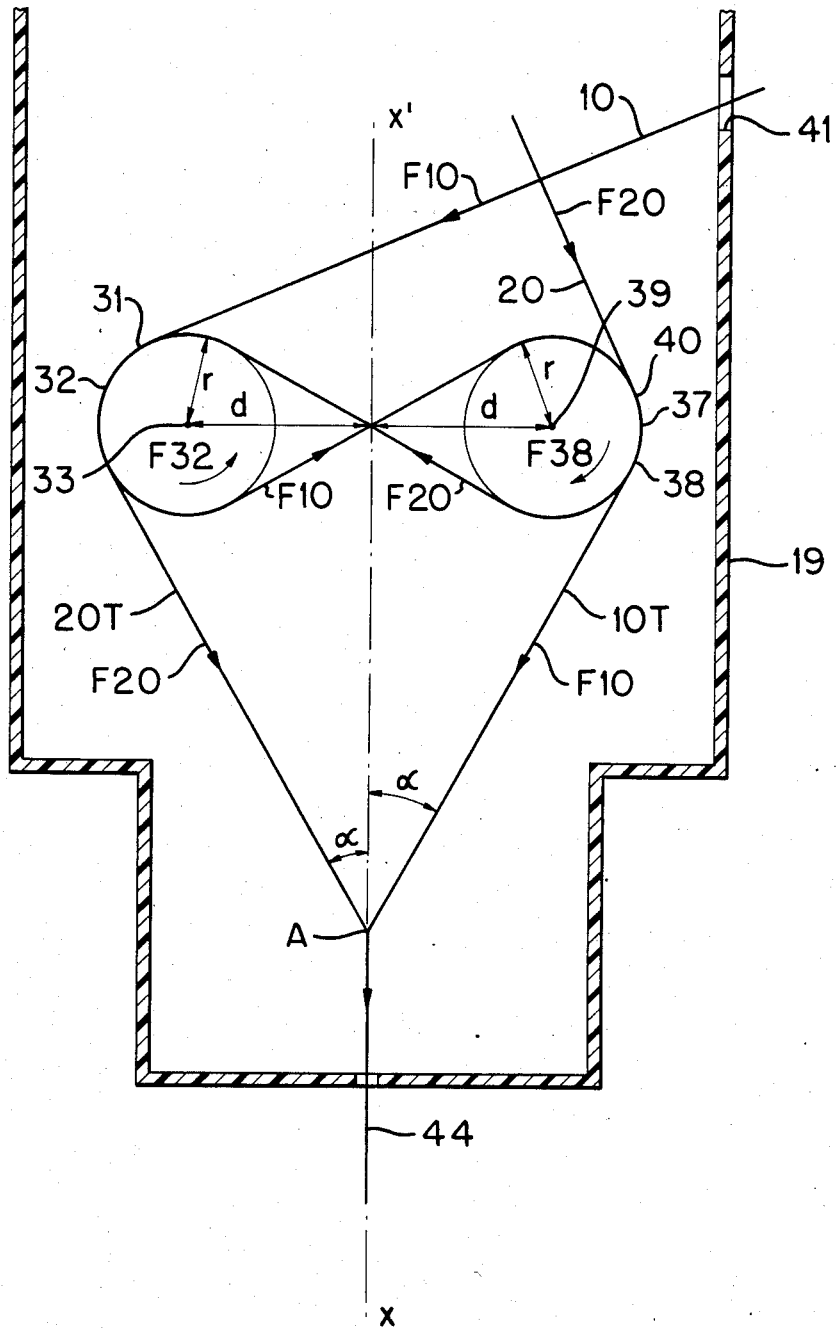
FIG. 2 shows in cross-sectional view and in further detail the downstream guides of the device shown in FIG. 1.

The downstream guides 31, 37 are interconnected by the threads 10, 20, the assembly of these guides 31, 37 producing a regulator system 40, which is shown in greater detail in FIG. 2. In FIG. 2, the direction of advance of each thread 10, 20 is represented by the arrow F10, F20 as in FIG. 1. The thread 10 passes over the roller 32 of the downstream guide 31 and then over the roller 38 of the downstream guide 37, emerging from the system 40 as from the roller 38. In similar fashion, the thread 20 passes over the roller 38 of the downstream guide 37 and then over the roller 32 of the downstream guide 31, emerging from the system 40 as from the roller 32. These rollers 32, 38 are driven in rotation around their shafts 33, 39 by the threads 10, 20 which therefore pass in the same direction over each of these rollers, the assembly of these rollers 32, 38 furthermore turning around the axis xx' with the same angular speed as the rotating assembly 24 as previously described since their shafts 33, 39 are integral with the spindle 19 and are therefore driven in rotation around the axis xx' by the spindle 19. The rotation of the roller 32, indicated schematically by the arrow F32, is in the opposite direction as that of the roller 38, indicated diagrammatically by the arrow F38, the threads 10, 20 having therefore crossed directions of advance F10, F20 between these rollers 32, 38, without these threads touching each other between these rollers or on these rollers. This result is obtained, for instance, by passing the threads 10, 20 over two grooves of identical diameter for each of the rollers 32, 38. These grooves have not been shown in the drawing, for purposes of simplification. One thus obtains the same linear speed for the twisted multifilaments 10T, 20T at the outlet from the system 40 when the tensions imparted to the threads 10, 20 due to the regulator systems 26, 14 are equal or slightly different, these tensions being greater than a minimum threshold imposed by the necessity of each of the threads 10, 20 adhering to the rollers 32, 38.

The rollers 32, 38 preferably have identical shapes and dimensions and the ratio d/r is preferably between 1.2 and 4, "d" being the distance of each shaft 33, 39 from the axis xx', and "r" being the outside radius of the rollers 32, 38 (FIG. 2).

The advance of the thread 20 between the guides 36, 37 takes place within the spindle 19, and the thread 10, coming from the guide 30, enters the spindle 19 through the opening 41 so as to arrive at the downstream guide 31 (FIG. 2) without the threads 10, 20 being in contact with each other within the spindle 19.

The twisted multifilaments 10T, 20T emerging from the rollers 38, 32 are then combined at a free point A on the axis xx' and caused to pass over the roller 42, the shaft 43 of which is fixed in space (FIG. 1). These two threads 10T, 20T are therefore twisted together between the point A and the roller 42 in view of the joint rotation of the rollers 32, 38 around the axis xx', this twist, called "ply twist," having a direction opposite to the rotation of the drum 3. When the assembly 25 is stationary, the twist previously given in the device 100 to the threads 10, 20 between the upstream guides 29, 36 and the downstream guides 31, 37 is eliminated between the point A and the roller 42.

The passage of the twisted multifilaments 10T, 20T between the free point A and the roller 42 during their assembly takes place along the axis xx' within the drive cylinder 21, which is hollow.

The assembly 44 thus obtained is a ply which passes over the capstan 45 and which is wound onto the bobbin 46, the capstan 45 making it possible to regulate the linear speed of the ply 44 and therefore the linear speed of the threads 10, 20 before their assembly.

The invention makes it possible to obtain the following advantages as compared with the known rotating-disk devices:

the tension of the threads 10, 20 is reduced during their passage in the device 100 prior to their assembly, this being due, in particular, to the fact that the thread 10 is applied against the inner face 9 of the drum 3 during its rotation instead of turning freely in the air around the bobbin 2;

the regulator system 40, which makes it possible to regulate the speed of the twisted multifilaments 10T, 20T, is integral with the spindle 19 and therefore with the rotating assembly 24 of the device 100 and is driven in rotation by the motor 4. The inertia of this system 40 upon the starting or stopping of the device 100 is therefore not experienced by the twisted multifilaments 10T, 20T. The tension of these threads 10T, 20T upon starting or stopping is therefore decreased and the device 100 permits rapid accelerations and decelerations.

Furthermore, the fact that the assembly point A of the twisted multifilaments 10T, 20T is free on the axis xx' makes it possible to avoid the use of a guide, for instance an eye, which eliminates the risk of abrasion at this point.

Furthermore, the fact that the point A is free on the axis xx' permits each twisted multifilament 10T, 20T to enter into the ply 44 along an angle $\alpha$ formed by the axis of this thread 10T, 20T with the axis xx', this angle $\alpha$ being equal to the natural helix angle in the ply 44. FIG. 2 shows the angles $\alpha$ corresponding to the twisted multifilaments 10T and 20T.

Finally, the fact that the threads 10, 20 are always separate from each other before their assembly at the point A eliminates the risk of abrasion and entanglement of these threads by mutual contact.

These advantages lead to plies 44 which have better mechanical properties than those of the ply threads obtained with the known disk devices.

By way of example, the device 100 is used to produce two plies 44, one of which is a ply of aromatic polyamide and the other a ply of rayon, each of these two plies being obtained with two threads 10, 20 which are multifilaments. The properties of the multifilaments 10, 20 and of the plies 44 obtained are given in the following table:

TABLE

| Property | Material | |
|---|---|---|
| | Aromatic Polyamide | Rayon |
| Multifilaments | | |
| Denier | 167 | 244 |

TABLE-continued

| Property | Material: Aromatic Polyamide | Material: Rayon |
|---|---|---|
| Twist obtained in the device 100 before assembly | Z 315 | Z 385 |
| Ply | | |
| Ply twist | S 315 | S 385 |
| Rupture force | 647 | 215 |
| Elongation | 3.1 | 4.1 |

Remarks

The denier of the multifilaments is given in tex for each of these multifilaments which are initially without twist on the bobbins 1, 2.

The twists are expressed in numbers of turns per meter and the letter Z or S which precedes the value of the twist is currently used in the textile industry and indicates that the twist is effected in the Z direction (for the letter Z) or in the S direction (for the letter S), the Z direction and the S direction being opposite to each other.

The rupture force is expressed in Newtons.

The elongation is determined with a force of 250 Newtons for the ply of aromatic polyamide and with a force of Newtons for the ply of rayon. This elongation is expressed in percent.

These plies are obtained in the device 100 while maintaining the assembly 25 stationary.

As compared with a known method of assembly with rotating disk, the improvements due to the invention are the following, starting from the same multifilaments and obtaining the same twists:

Ply of aromatic polyamide the rupture force is increased by 11%.

the elongation is decreased by 8%.

Ply of rayon the rupture force is increased by 13%.

the elongation is decreased by 7%.

It is therefore clear that the device 100 of the invention makes it possible to increase the rupture force and decrease the elongation, which results in an increase in the modulus, and this by a substantial amount.

Another advantage of the device 100 described above results from the fact that the regulator system 14 of the thread 20 is in the form of a cylinder 13 arranged within the drum 3; it is therefore easy to remove the bobbin 2 in order to replace it by another bobbin during the operation of the device 100, and to do this without having to remove the system 14 which therefore remains as it is, provided with thread 20.

The device 100 has been described as making it possible preferentially to produce a ply from two multifilaments but this device 100 could be used to produce assemblies with threads other than multifilaments, for instance starting with at least one thread formed of a ply in order to obtain a cable.

It is also possible to use in the device 100 a plurality of bobbins 1 located on the outside of the drum 3 and/or a plurality of bobbins 2 located within the drum 3, each of these bobbins bearing, for instance, a monofilament, the twist of these threads 10, 20 between the upstream guides 29, 36 and downstream guides 31, 37 corresponding to these threads then making it possible to twist these threads of the same group together in order to obtain a multifilament.

Of course, the invention is not limited to the embodiments which have been described above. Thus, for instance, the regulator system 40 could be driven in rotation around the axis xx' by means other than the motor 4, but the use of the motor 4 in order to turn both the rotating assembly 24 and the regulator system 40 has the advantage of simplicity.

What is claimed is:

1. A device for assembling at least two threads which comprises:

(a) a first group and a second group of bobbins, the first group being formed by at least one first bobbin on each of which is wound at least one first thread and the second group being formed by at least one second bobbin on each of which is wound at least one second thread;

(b) a wall and means for driving the wall in rotation around an axis;

(c) means for immobilizing the second bobbin during the rotation of the wall;

(d) first twisting means for twisting the first thread in the direction of rotation of the wall, the first twisting means being formed, at least in part, by a first upstream guide, a first downstream guide and the wall; the first twisting means permitting the first thread to come into contact with the inner face of the wall between said first guides and to turn jointly with the wall around the axis, turning around the second bobbin without making contact with the second bobbin;

(e) second twisting means for twisting the second thread in the direction of rotation of the wall, the second twisting means being formed, at least in part, by a second upstream guide and a second downstream guide; the direction in which it is necessary to move along the axis of rotation in order to pass from a plane passing through the first upstream guide to a plane passing through the first downstream guide being the same as the direction in which it is necessary to move along said axis in order to pass from a plane passing through the second upstream guide to a plane passing through the second downstream guide, said planes being perpendicular to said axis;

(f) means other than the threads for driving the downstream guides in rotation around the axis of rotation of the wall in the same direction and at the same angular speed as the wall; and (g) means for assembling the first thread with the second thread after the passage of these threads over the downstream guides by twisting these threads together in a direction opposite the direction of rotation of the wall.

2. A device for assembling at least two threads which comprises:

(a) a first group and a second group of bobbins, the first group being formed by at least one first bobbin on each of which is wound at least one first thread and the second group being formed by at least one second bobbin on each of which is wound at least one second thread;

(b) a wall and means for driving the wall in rotation around an axis;

(c) means for imparting to the second bobbin a rotation independent of the rotation of the wall;

(d) first twisting means for twisting the first thread in the direction of rotation of the wall, the first twisting means being formed, at least in part, by a first upstream guide, a first downstream guide and the wall; the first twisting means permitting the first thread to come into contact with the inner face of the wall between said first guides and to turn jointly with the wall around the axis, turning around the second bobbin without making contact with the second bobbin;

(e) second twisting means for twisting the second thread in the direction of rotation of the wall, the second twisting means being formed, at least in part, by a second upstream guide and a second downstream guide; the direction in which it is necessary to move along the axis of rotation in order to pass from a plane passing through the first upstream guide to a plane passing through the first downstream guide being the same as the direction in which it is necessary to move along said axis in order to pass from a plane passing through the second upstream guide to a plane passing through the second downstream guide, said planes being perpendicular to said axis;

(f) means other than the threads for driving the downstream guides in rotation around the axis of rotation of the wall in the same direction and at the same angular speed as the wall; and (g) means for assembling the first thread with the second thread after the passage of these threads over the downstream guides by twisting these threads together in a direction opposite the direction of rotation of the wall.

3. A device according to claim 1 or 2 wherein the wall is formed of a drum, the first bobbin being arranged outside the drum and the second bobbin being arranged inside the drum.

4. A device according to claim 1 or 2 wherein at least one of the downstream guides is a roller driven in rotation around its axis by the thread for which this roller serves as a downstream guide, this roller furthermore turning around the axis of rotation of the wall.

5. A device according to claim 4 wherein the two downstream guides are rollers driven in rotation by the threads for which these rollers serve as downstream guides, these rollers forming a regulator system which turns around the axis of rotation of the wall.

6. A device according to claim 5 wherein the two rollers are arranged on the inside of a hollow spindle, the shafts of these rollers being integral with the spindle, the spindle being driven in rotation around the axis of rotation in the same direction and at the same angular speed as the wall.

7. A device according to claim 6 wherein the downstream guides are connected together by the first thread and the second thread, the first thread passing from the first downstream guide to the second downstream guide and the second thread passing from the second downstream guide to the first downstream guide.

8. A device according to claim 1 or 2 wherein the means for assembling the first thread with second thread are such as to permit the combining of the threads at a free point on the axis of rotation.

9. A device according to claim 8 wherein the assembling means comprise a hollow drive cylinder within which the assembled threads pass.

10. A device according to claim 1 or 2 which further comprises means for regulating the tension of at least one thread.

11. A device according to claim 10 wherein the wall is formed by a drum and the tension regulating means are for the second thread, these means being arranged within the drum.

12. A device according to claim 1 or 2 wherein the means for driving the downstream guides in rotation are the same as the means for driving the wall in rotation.

13. A method for assembling at least two threads which comprises:

(a) using a first group and a second group of bobbins, the first group being formed by at least one first bobbin on each of which is wound at least one first thread and the second group being formed by at least one second bobbin on each of which is wound at least one second thread;

(b) using a wall which is driven in rotation around an axis;

(c) immobilizing the second bobbin during the rotation of the wall;

(d) twisting the first thread in the direction of rotation of the wall, between a first upstream guide and a first downstream guide, said twisting operation being effected in such a manner that the first thread comes into contact with the inner face of the wall, between said first guides, and turns jointly with the wall around the axis, turning around the second bobbin without making contact with the second bobbin;

(e) twisting the second thread in the direction of rotation of the wall between a second upstream guide and a second downstream guide, the direction in which it is necessary to move along the axis of rotation in order to pass from a plane passing through the first upstream guide to a plane passing through the first downstream guide being the same as the direction in which it is necessary to move along said axis in order to pass from a plane passing through the second upstream guide to a plane passing through the second downstream guide, said planes being perpendicular to said axis;

(f) driving the downstream guides in rotation around the axis of rotation of the wall, with means other than the threads, in the same direction and at the same angular speed as the wall; and (g) assembling the first thread with the second thread by twisting these threads together in the direction opposite the direction of rotation of the wall.

14. A method for assembling at least two threads which comprises:

(a) using a first group and a second group of bobbins, the first group being formed by at least one first bobbin on each of which is wound at least one first thread and the second group being formed by at least one second bobbin on each of which is wound at least one second thread;

(b) using a wall which is driven in rotation around an axis;

(c) imparting to the second bobbin a rotation independent of the rotation of the wall;

(d) twisting the first thread in the direction of rotation of the wall, between a first upstream guide and a first downstream guide, said twisting operation being effected in such a manner that the first thread comes into contact with the inner face of the wall, between said first guides, and turns jointly with the wall around the axis, turning around the second bobbin without making contact with the second bobbin;

(e) twisting the second thread in the direction of rotation of the wall between a second upstream guide and a second downstream guide, the direction in which it is necessary to move along the axis of rotation in order to pass from a plane passing through the first upstream guide to a plane passing through the first downstream guide being the same as the direction in which it is necessary to move along said axis in order to pass from a plane passing through the second upstream guide to a plane passing through the second downstream guide, said planes being perpendicular to said axis;

(f) driving the downstream guides in rotation around the axis of rotation of the wall, with means other than the threads, in the same direction and at the same angular speed as the wall; and (g) assembling the first thread with the second thread by twisting these threads together in the direction opposite the direction of rotation of the wall.

* * * * *

UNITED STATES PATENT AND TRADEMARK OFFICE

CERTIFICATE OF CORRECTION

PATENT NO. : 4,689,942

DATED : September 1, 1987

INVENTOR(S) : Fernand Chateau

It is certified that error appears in the above-identified patent and that said Letters Patent is hereby corrected as shown below:

Col. 7, line 28, before "Newtons" insert -- 50 --.

Signed and Sealed this

Fifteenth Day of March, 1988

*Attest:*

*Attesting Officer*

DONALD J. QUIGG

*Commissioner of Patents and Trademarks*